United States Patent [19]

Collin

[11] 4,000,060

[45] Dec. 28, 1976

[54] MAGNETIC SEPARATOR FOR HOT MIXTURES CONTAINING MAGNETIC COMPONENTS

[75] Inventor: Per Harald Collin, Falun, Sweden

[73] Assignee: Allmanna Svenska Elektriska Aktiebolaget, Vasteras, Sweden

[22] Filed: Jan. 23, 1975

[21] Appl. No.: 543,486

[30] Foreign Application Priority Data

Jan. 28, 1974 Sweden ..... 7401028

[52] U.S. Cl. ..... 209/11; 209/223 R; 209/231

[51] Int. Cl.[2] ..... B03B 1/02

[58] Field of Search ..... 209/223 R, 223 A, 228, 209/231, 11, 8

[56] References Cited

UNITED STATES PATENTS

| | | | |
|---|---|---|---|
| 2,371,665 | 3/1945 | Wulff | 209/11 X |
| 2,394,578 | 2/1946 | Wulff | 209/11 X |
| 2,441,594 | 5/1948 | Ramseyer | 209/11 X |
| 2,987,184 | 6/1961 | Ferris | 209/223 R |
| 3,168,464 | 2/1965 | Ferris | 209/223 R |
| 3,327,852 | 6/1967 | Murtsell | 209/223 R X |
| 3,407,930 | 10/1968 | Morel | 209/11 |

FOREIGN PATENTS OR APPLICATIONS

| | | | |
|---|---|---|---|
| 845,331 | 7/1952 | Germany | 209/223 R |
| 508,300 | 6/1939 | United Kingdom | 209/223 |

*Primary Examiner*—Robert Halper
*Attorney, Agent, or Firm*—Kenyon & Kenyon Reilly Carr & Chapin

[57] ABSTRACT

A magnetic separator for a hot mixture has an enclosure with a bottom having means for fluidizing the mixture which travels through the enclosure from an entrance to an exit. Within the enclosure an internally water-cooled drum rotates and which is internally provided with magnetizing means so that magnetic particles in the fluidized flow, into which the drum dips, is picked up and through a suitable discharge carried out of the enclosure, other material in the mixture and which is non-magnetic, discharging from the enclosure. Internally the drum has means for maintaining a body of water in the drum's portion which dips into the fluidized flow, the flow of hot mixture causing the water to vaporize and cool that portion of the drum.

6 Claims, 2 Drawing Figures

MAGNETIC SEPARATOR FOR HOT MIXTURES CONTAINING MAGNETIC COMPONENTS

BACKGROUND OF THE INVENTION

In the direct reduction of iron from ore mixed with an excess of coke and with heating of the mixture to elevated temperatures substantially exceeding the Curie point of iron, the ferrous component of the ore is reduced to iron, the process producing a flow of particles of the iron and excess coke. For further processing the iron particles must be separated from the coke particles so that the separated iron particles can be by heating made into an iron melt which can be refined into steel by techniques involving melting of the iron particles.

Because the direct reduction of the iron ore into iron is effected by heat, the mixture of iron and excess coke particles leaving that stage of the process are, of course, at elevated temperatures substantially above the Curie point of the iron particles. The use of prior art apparatus and methods for separating the iron particles from the coke, requires cooling of the mixture not only to below the Curie point of the iron particles, but also to substantially lower temperatures demanded by the practical operating requirements of prior art magnetic separators. Because this substantial cooling is required, the subsequent melting of the iron particles, required for the production of a melt which can be processed into steel, involves a high reheating cost.

It follows that if the hot mixture of the magnetic particles comprising the iron, could be separated from the equally hot non-magnetic coke particles, that a substantial cost saving could be effected, because the magnetic particles could be passed on for reheating at a lower cost to effect the formation of a melt for refining purposes.

SUMMARY OF THE INVENTION

The purpose of the present invention is to provide an apparatus or magnetic separator capable of effectively separating the magnetic iron particles from the non-magnetic coke particles, and other non-magnetic particles may be included in the mixture, without reducing the temperature of the mixture any more than is required for the magnetic separating phase, so that the separated magnetic particles can be sent on for the production of a melt, while the magnetic particles retain a substantial amount of the heat put onto them for their direct reduction from the iron ore and in the presence of the coke particles, while resulted in the mixture which requires separation. In addition, due to this, the apparatus to be used must be capable of operating effectively under the elevated temperature conditions involved.

According to the invention, this is done by providing an enclosure having an inlet and an outlet and a bottom to which pressurized inert gas is introduced under a pressure adequate to fluidize the particles as they flow from the entrance to the exit within the enclosure. A refractory drum dips into the flow of fluidized particles and is internally provided not only with a stationarily positioned, arcuate array of magnets, but also with a means for maintaining a puddle or body of water in the bottom of the drum which, under the temperature conditions involved, boils and by evaporation constantly maintains the dipped portion of the drum under highly cooling conditions.

By rotating the drum at an adequate speed, the picked-up magnetic particles, after leaving the segment of the drum having its external segment provided with the magnetic field, are centrifugally thrown away, the upper portion of the drum having an inverted funnel-like discharge opening for the separated magnetic particles. With the fluidizing means requiring compressed gas, the pressurized gas used for this purpose escaping upwardly through the layer of traveling particles, the interior of the enclosure is under a relatively high gas pressure, and because the enclosure provides an escape for this pressure only through the magnetic particle discharging means receiving the particles from the drum, the pressurized gas used for fluidizing the flow through the enclosure, performs the additional function of pneumatically carrying the magnetic particles through the discharge opening of the enclosure.

The portion of the rotating drum which is free from the flow or layer of fluidized hot particles, is exposed only to the heat of the fludizing gas escaping upwardly through the fluidized layer of particles, and, therefore, this portion of the drum can be adequately cooled by spraying it internally via water spray or sprays. The water falling from these sprays can be used to form the puddle or body of water in the lower portion of the rotating drum and which by suitable means of discharge is maintained at an appropriate level. Because the boiling water in the bottom of the drum provides the interior of the drum with vapor under pressure, this pressure can be used to provide a controlled discharge of cooling water from the drum.

BRIEF DESCRIPTION OF THE DRAWINGS

The presently preferred mode for carrying out this invention is schematically illustrated by the accompanying drawings in which.

DETAILED DESCRIPTION OF THE INVENTION

Figure 1:
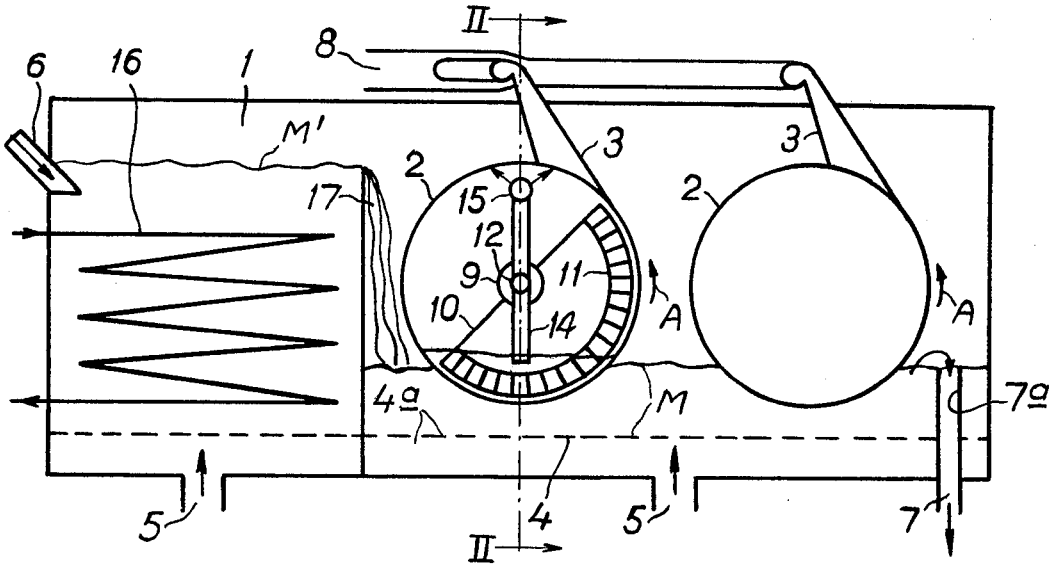
FIG. 1 is a vertical section through an apparatus embodying the principles of the invention.
Figure 2:
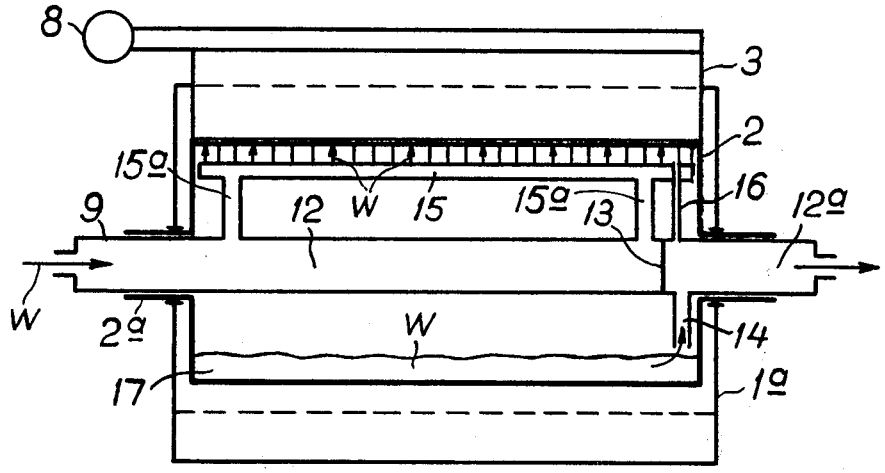
FIG. 2 is a cross section taken on the line II—II in FIG. 1.

Having reference to the above drawings, a gas-tight enclosure 1 contains the non-magnetic drum 2 made of refractory material and which rotates in the direction of the arrow peripherally towards the magnetic material discharge 3 which is in the form of an inverted funnel having a mouth extending for the axial length of the drum 2 and which rides very adjacent to, not in contact with, the periphery of the drum 2. The means for providing the fluidized traveling layer of the mixture is shown at 4 as comprising a perforated bottom plate spaced above the bottom of the enclosure 1 and having a large number of perforations 4*a*, the bottom of the enclosure 1 being provided below this perforated plate 4 with inlets 5 for a pressurized gas which, at the elevated temperatures of the mixture, slightly below the Curie point of the magnetic particles as explained hereinafter, is an inert gas with respect to the magnetic particles of iron. Nitrogen under adequate pressure to fluidize the mixture, is an example of such a gas.

The enclosure 1 is provided at one end and at an elevated position with an inlet 6 for receiving the hot mixture of magnetic iron particles and non-magnetic coke particles produced by the preceding step of direct reduction of the iron ore through the medium of heat and the excess of coke particles. The entering temperature of this mixture is above the Curie point of the magnetic iron particles. At the other or back end of the enclosure 1, a non-magnetic particles discharge 7 is provided, and as shown, this may comprise a channel 7*a* extending upwardly within the enclosure as required to maintain a level of the fluidized mixture flow through the enclosure 1, which is adequate for the drum 2 to have a substantial portion of its periphery to dip into. The magnetic particle discharge 3 is shown as connecting with a conveyor pipe 8 which can carry the magnetic particles on to a succeeding step wherein these particles may be formed into a melt for refinement purposes. Incidentally, at this point it is appropriate to note that in FIG. 1 a second drum and discharge arrangement 3 is shown, operating in series with the first drum and its components, thus illustrating that the apparatus of this invention may use two or more drums, depending on the separation efficiency desired or required.

The drum 2 is horizontally aligned, and a non-rotative tubular shaft 9 extends through this drum and through the vertical side walls 1*a* of the enclosure 1. The drum 2 is journaled on this tubular shaft 9 with journals 2*a* extending through the side walls 1*a* to have external portions outside of the enclosure 1 and available for receiving a rotary driving force with the drum 2 rotating in the direction of the arrows A shown in FIG. 1. This non-rotative shaft 9 mounts a non-rotative sector or segment 10 inside of the drum 2 and supporting permanent magnets 11 of successively alternating polarity. These create a magnetic field on the outside of the rotative drum 2, throughout an arc segment extending through about 180° and extending from the portion of the drum 2 which dips into the advancing layer of the mixture, indicated at M, and extending in the rotative direction of the drum 2, shown by the arrow A, to the limit of the 180° segment, at which point the discharge arrangement or inverted funnel 3 takes over to remove the particles carried from the mixture by the drum 2, the particles being discharged both by centrifugal force, with adequate drum rotative speed, and by the pneumatic force resulting from the pressurized gas required to fluidize the layer of mixture M and which, of course, escapes from this layer upwardly to place the entire enclosure 1 under a substantial super-atmospheric pressure. In this connection, it is to be understood that the mixture of particles can be fed in at 6 against such a pressure.

The cooling water, indicated by the arrows W, is fed into the interior of the tubular shaft 9 at one end so as to fill the space 12, this space extending substantially to the opposite end of the drum 2 where a dam or closing wall or partition 13 closes that end of the space 12 within the tubular shaft 9. Beyond this partition 13, a pipe 14 depends into the puddle, pool or body of water in the bottom of the rotating drum 2, the length of this pipe establishing the depth of the pool of water W, which heated by the mixture M, continuously boils, the water introduced into the tubular shaft 9 being under a pressure adequately high for the introduction of the water against the vapor pressure consequently produced within the drum 2. This water, meeting the partition 13, is fed to a horizontal upwardly perforated spray pipe 15 which sprays the interior portion of the drum 2 which is free from direct contact with the layer of mixture M, such water spraying, therefore, being adequate for effective and safe cooling of the drum 2. This horizontal spray pipe 15 connects with the interior 12 of the horizontal tubular shaft 9, by way of vertical pipe extensions 15*a*. The spray water falling, forms the puddle or pool of water W which boils or vaporizes in the bottom of the drum 2. To avoid any chance for a vapor interlock, a vent pipe 16 extends from the upper portion of the drum 2, down to the portion of the tubular shaft 9 beyond or on the discharge side of the partition 13, shown at 12*a*. Water is introduced to the shaft 9 at a flow rate in excess of that required to provide a proper level for the pool or body of water in the bottom of the drum 2, as required for effective spraying through the spray pipe 15, the steam or vapor pressure within the drum, driving the excess upwardly through the pipe 14 which depends from the shaft 9, and into the space 12*a* for discharge, thus maintaining a proper pool or water level in the bottom of the drum 2. The mixture inlet 6 feeds to below a deep body of the mixture M maintained at a high level M′ above the otherwise normal level, by means of a dam 17 positioned in front of or upstream of the drum 2. This deep body of initially introduced mixture is also fluidized, as described before, and a water cooling coil 16 is positioned within this large, deep or high body of initially introduced mixture, this coil 16 and its supply of cooling water being designed to drop the temperature of the initially introduced mixture, from the preceding direct reduction step, so that when the mixture overflows the dam 17 and gets to below the drum 2 which dips into the layer of the flowing mixture, the temperature of the mixture is dropped to at least slightly below the Curie temperature of the magnetic particles which this mixture contains.

In operation, the mixture of magnetic and non-magnetic particles from the preceding step, of necessity at a temperature above the Curie point of iron, flows through 6 to form the deep or high layer M′ of the mixture, confined by the dam 17. The cooling coil 16 drops the temperature of this body of mixture to a temperature at least slightly below the Curie point of iron but no more than is necessary for this purpose. Therefore, the material flowing over the top of the dam 17 to form the fluidized layer M, compressed nitrogen being introduced at the inlets 5, has a temperature of, for example, in the neighborhood of slightly less than 750° C.

The overflowing hot mixture forms the layer established by the height of the exit arrangement 7*a*, and which flows, possibly rapidly, under the portion of the drum 2 which dips into the layer. This drum is rotated at a very high speed and because of the magnetic segment, within the flux field of the segment 10 having the magnets 11, picks up the magnetic particles and throws them into the inverted funnel-shaped magnetic particle discharge arrangement 3, the fluidizing gas within the enclosure 1 exhausting through this same discharge arrangement and carrying the magnetic particles in a pneumatic manner, along, the result being a discharge from the enclosure of a fluidized flow of the separated magnetic particles.

The pool or body of water W in the bottom portion of the rotating drum 2 is heated to above the boiling temperature of water and by its vaporization provides effective cooling of the dipping portion of the drum 2. The portion of the drum above the layer of hot mixture, is heated only by radiation from this mixture and by the heat picked up from the layer by the fluidizing gas. Therefore, this portion of the drum, which is its upper or top portion, is adequately cooled simply by the water spraying through the spraying pipe 15. It is the water from this spray that falls to form the pool of water in the bottom of the drum.

With the development of vapor pressure in the drum, the pool or body of water in its bottom is automatically maintained because any excess is driven up through the level-control pipe 14, into the space 12*a* and discharged.

As indicated by the second one of the drums 2, illustrated as being in series with the first drum, described in detail hereinbefore and the features of which may be included by both drums, a plurality of drums operating in series may be used, depending upon the efficiency and completeness of magnetic particle separation desired.

Although the arcuate series of magnets 11 may be permanent magnets oriented alternately north and south with respect to the exterior periphery of the refractory drum 2, electromagnets could also be used. The high temperatures involved make permanent magnets somewhat more appropriate and in this connection the flow of cooling water must be adequate to keep the magnets 11 below demagnetizing temperatures.

The coke particles discharged at 7 may be reused; the separated magnetic particles obtained from the preceding direct reduction step, are, of course, sent on to form a melt for refinement purposes. In this connection, because the magnetic separation can be effected at very high temperature, because of the cooling effected by the vaporization of the body of water inside the lower portion of the drum 2, assisted by the subsequent internal spraying, the separated particles may produce a fluidized flow of particles formed by the fluidizing gas heated by the hot layer of mixture M, and the separated magnetic particles which may have temperatures slightly below the Curie point of iron, it becomes possible to greatly reduce the costs of reheating the separated magnetic particles, to above their melting temperatures to form the melt required for the subsequent refinement step. In other words, instead of wasting the heat of the mixture of iron and coke particles resulting from the preceding direct reduction step, this heat, to the extent that it is at least slightly below the Curie point of iron, is saved. The heat is picked up by the fluidizing gas, the separated magnetic particles retain a substantial amount of their original heat, and a fluidized flow of hot gas and iron particles is obtained for delivery to the subsequent phase of melting and refining.

The drum 2 is made of non-magnetic material which is adequately resistant to the temperatures involved by the drum's operating conditions. At least, the drum's periphery that rotates in the magnetic field must be non-magnetic. The dam 17 retains an adequately cooling reservoir of the mixture, so that the mixture flowing over the dam is just cool enough for magnetic attraction of the magnetic particles. The mouth of the magnetic particles discharge, is positioned throughout a drum segment substantially opposite to the flowing layer of mixture.

What is claimed is:

1. A magnetic separator for a hot dry mixture of magnetic and non-magnetic particles, said separator comprising an enclosure, a substantially horizontal refractory drum having a non-magnetic periphery and rotatively positioned in said enclosure for rotation in one rotative direction, pressurized-gas means for forming a gas-fluidized layer of said mixture in said enclosure with the layer having a top level into which a lower portion of the drum's said periphery rotatively dips while leaving the balance of said periphery above the top level of said layer, magnetic means inside of said drum for forming a stationary magnetic flux field on the outside of said drum throughout at least a substantial extent of the drum's said lower portion and extending upwardly therefrom around the drum's said periphery in the drum's said rotative direction and terminating before reaching an upper segment of the rotative drum's said periphery which is above and substantially opposite to said lower portion of the drum's periphery, said flux field attracting said magnetic particles to the outside of said drum's periphery throughout said extent of the flux field and the magnetic particles being released therefrom as the drum's periphery rotates through said upper segment, discharge means for carrying away from said enclosure magnetic particles released from said upper segment of said periphery, spray means inside of said drum for spraying with water the inside of the drum's said upper segment of its periphery, and water-retaining means for maintaining a body of water inside of said drum substantially throughout the drum's said lower portion of its periphery, said drum having an exhaust for steam generated therein from said body of water.

2. The separator of claim 1 in which said drum has a non-rotative tubular mounting shaft having inlet and outlet ends extending through said enclosure and on which said drum is rotatively journaled, said spray means comprising a spray-pipe extending substantially horizontally under the inside of said upper segment of said drum's periphery, and tubular arms inside of said drum and mounting said spray-pipe on said mounting shaft and in fluid-connection therewith, said inlet end of said mounting shaft forming a water inlet and this shaft containing a partition within said drum and closing said shaft beyond said arms and adjacent to said outlet end of the shaft, to divert water through the arms and through said spray pipe.

3. The separator of claim 2 in which said water-retaining means and said exhaust is formed by a tubular fluid inlet pipe depending from said mounting shaft and in fluid-connection therewith beyond said partition and inside of said drum, said pipe terminating at a position spaced above the inside of the said portion of the drum's said periphery which dips below said layer's top level and said pipe exhausting water and steam through said shaft's said outlet end.

4. The separator of claim 1 in which said enclosure in substantially horizontal and has an inlet end having an inlet for a continuous input feed of said mixture at a level above the layer's said top level, and an outlet end having an outlet below the layer's said top level for a continuous discharging of the non-magnetic particles, said pressurized-gas means being formed by a substantially horizontal, perforated bed-plate carrying said layer above its top surface and having a bottom surface open to an enclosed space to which pressurized-gas can be continuously fed below this bottom surface, said drum being positioned between the enclosure's said ends and said discharge means being formed by a conduit having a mouth extending substantially along the axial extent of said drum and pointing opposite to the said rotative direction of said drum in the area of said upper segment, said conduit extending through said enclosure and pressurized-gas exhausting upwardly from said layer, discharging from said enclosure through said mouth and said conduit.

5. The separator of claim 1 in which said enclosure has an inlet for a continuous input feed of said mixture and an outlet for said non-magnetic particles, said inlet and outlet being positioned so that said gas-fluidized layer flows past said drum in the same direction as the rotating direction of said drum's said periphery which dips below the layer's said top level.

6. The separator of claim 5 having means between said inlet and said drum for forming a dam damming said mixture to form a gas-fluidized reservoir of said mixture and which is of substantially greater depth than the depth of said layer, and means for cooling said mixture in said reservoir, said mixture flowing over said dam to said layer.

* * * * *